US008276215B2

(12) United States Patent
Merkle et al.

(10) Patent No.: US 8,276,215 B2
(45) **Date of Patent: *Oct. 2, 2012**

(54) TEMPERATURE SENSING GLOVE FOR AUTOMOTIVE APPLICATIONS

(76) Inventors: Denise Lynn Merkle, Ft. Worth, TX (US); Nelson E. Claytor, Ft. Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/171,955

(22) Filed: Jun. 29, 2011

(65) Prior Publication Data

US 2012/0002698 A1 Jan. 5, 2012

Related U.S. Application Data

(63) Continuation of application No. 12/396,327, filed on Mar. 2, 2009, now Pat. No. 8,001,620.

(60) Provisional application No. 61/068,078, filed on Mar. 4, 2008.

(51) Int. Cl.
*A63B 71/14* (2006.01)
*G08B 6/00* (2006.01)
*A41D 19/00* (2006.01)

(52) U.S. Cl. ..... 2/161.6; 2/159; 2/161.1

(58) Field of Classification Search ..... None
See application file for complete search history.

(56) References Cited

U.S. PATENT DOCUMENTS 2,736,034 A * 2/1956 Fradenhagen et al. ..... 2/159
4,414,537 A * 11/1983 Grimes ..... 341/20
5,444,462 A * 8/1995 Wambach ..... 345/158
5,486,112 A * 1/1996 Troudet et al. ..... 434/250
5,706,026 A * 1/1998 Kent et al. ..... 345/156
5,973,602 A * 10/1999 Cole et al. ..... 340/584
6,032,530 A * 3/2000 Hock ..... 73/379.01
6,080,690 A * 6/2000 Lebby et al. ..... 442/209
6,087,942 A * 7/2000 Sleichter et al. ..... 340/576
6,145,551 A * 11/2000 Jayaraman et al. ..... 139/387 R
6,148,280 A * 11/2000 Kramer ..... 702/153
6,210,771 B1 * 4/2001 Post et al. ..... 428/100
6,243,007 B1 * 6/2001 McLaughlin et al. ..... 340/447
6,315,009 B1 * 11/2001 Jayaraman et al. ..... 139/387 R
6,349,201 B1 * 2/2002 Ford ..... 455/404.1
6,388,422 B1 * 5/2002 Lew ..... 320/107
6,442,457 B1 * 8/2002 Jones et al. ..... 701/33.2
6,515,669 B1 * 2/2003 Mohri ..... 345/474
6,595,918 B2 * 7/2003 Gopinathan et al. ..... 600/300
6,707,447 B1 * 3/2004 Goranowski ..... 345/167
6,779,392 B2 * 8/2004 Bell et al. ..... 73/146.8
6,861,945 B2 * 3/2005 Kim et al. ..... 340/407.1
6,965,374 B2 * 11/2005 Villet et al. ..... 345/169
7,077,191 B2 * 7/2006 Merkle ..... 165/168
7,089,099 B2 * 8/2006 Shostak et al. ..... 701/29.6
7,191,803 B2 * 3/2007 Orr et al. ..... 139/421
7,250,852 B1 * 7/2007 Kell ..... 340/447
7,446,755 B1 * 11/2008 Goren ..... 345/161
8,001,620 B2 * 8/2011 Merkle et al. ..... 2/161.6
2002/0190853 A1 * 12/2002 Nigon et al. ..... 340/448
2003/0009087 A1 * 1/2003 Keirsbilck ..... 600/300
2003/0214408 A1 * 11/2003 Grajales et al. ..... 340/573.1

(Continued)

*Primary Examiner* — Bobby H Muromoto, Jr.
(74) *Attorney, Agent, or Firm* — Fortkort & Houston P.C.; John A. Fortknot

(57) ABSTRACT

A temperature sensing glove (101) is provided. The glove includes a temperature sensor (131); a plurality of memory locations; and an assigning algorithm (121, 123) for assigning a temperature reading made by the temperature sensor to one of the plurality of memory locations.

22 Claims, 7 Drawing Sheets

U.S. PATENT DOCUMENTS

2004/0121294 A1* 6/2004 Lord et al. ..... 434/262
2004/0130442 A1* 7/2004 Breed et al. ..... 340/443
2004/0194911 A1* 10/2004 Merkle ..... 165/11.1
2005/0017868 A1* 1/2005 Yang ..... 340/650
2005/0099503 A1* 5/2005 Kitabayashi ..... 348/211.99
2005/0192727 A1* 9/2005 Shostak et al. ..... 701/37
2005/0225200 A1* 10/2005 Liu ..... 310/313 R
2006/0025897 A1* 2/2006 Shostak et al. ..... 701/1
2006/0059603 A1* 3/2006 Peng et al. ..... 2/161.7
2007/0225614 A1* 9/2007 Naghavi et al. ..... 600/549
2008/0211779 A1* 9/2008 Pryor ..... 345/173
2009/0156309 A1* 6/2009 Weston et al. ..... 463/39
2009/0204310 A1* 8/2009 Gittere ..... 701/102

* cited by examiner

TEMPERATURE SENSING GLOVE FOR AUTOMOTIVE APPLICATIONS

CROSS-REFERENCE TO RELATED APPLICATIONS

This application is a continuation of U.S. application Ser. No. 12/396,327, now allowed now U.S. Pat. No. 8,001,620, which application claims the benefit of priority from U.S. Provisional Application No. 61/068,078, filed Mar. 4, 2008, having the same title, and having the same inventors, and which is incorporated herein by reference in its entirety.

FIELD OF THE DISCLOSURE

The present disclosure relates generally to temperature sensing devices, and more particularly to a temperature sensing glove which is particularly useful for reading tire temperatures in automotive applications.

BACKGROUND OF THE DISCLOSURE

While success in high-speed motor sports is commonly attributed to driver skill, the proper set-up of a race vehicle is also an important factor. Consequently, both prior to and during a race, many aspects of a vehicle are subject to scrutiny and adjustment based on track conditions, driver perception, weather conditions, or even the skill level of competitors. Particular attention is paid to the elements of the suspension system of a vehicle, since these elements directly affect the driver's control over the vehicle.

Numerous types of suspension configurations are currently in use in modern vehicles. One common configuration includes upper and lower control arms which support a knuckle between them. The control arms are typically rigid members which may be stamped from steel or cast from another metal. A spring and shock absorber are typically connected to a portion of the lower control arm and to the vehicle's frame so as to provide a particular spring rate (a ratio which describes how resistant a spring is to being compressed or expanded during the spring's deflection) and to control the movement of the wheel supported on the knuckle.

The geometry of the upper and lower control arms has a direct effect on such important parameters as wheel camber (the angle of the wheel relative to a vertical axis, as viewed from the front or the rear of the vehicle), wheel caster (the angle to which the steering pivot axis is tilted forward or rearward from vertical, as viewed from the side of the vehicle) and toe (the angle to which the wheels are out of parallel), all of which have a significant impact on vehicle performance. For example, toe settings affect tire wear, straight-line stability, and the corner entry handling characteristics of the vehicle.

SUMMARY OF THE DISCLOSURE

In one aspect, a temperature sensing glove is provided which comprises a temperature sensor, a plurality of memory locations, and assigning means for assigning a temperature reading made by the temperature sensor to one or more of the plurality of memory locations.

BRIEF DESCRIPTION OF THE DRAWINGS

The devices and methodologies disclosed herein may be further understood with reference to the following figures, in which like numbers represent like elements.

DETAILED DESCRIPTION

Figure 1:
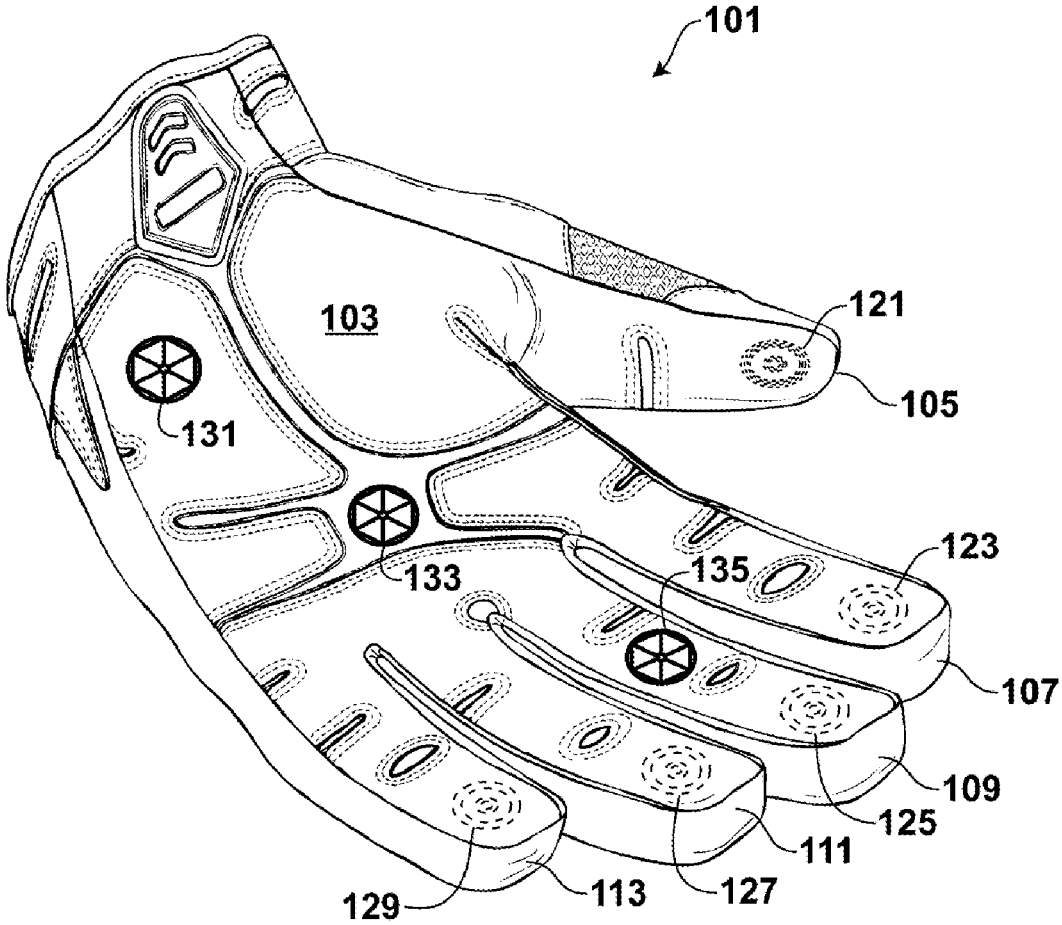
FIG. 1 is a perspective view of a first particular, non-limiting embodiment of a temperature sensing glove made in accordance with the teachings herein.

Tire temperature is one important metric utilized by pit crews to evaluate the performance of a suspension system. In particular, pit crews frequently measure the distribution of temperatures across the surface of a tire to glean information about the affect of wheel camber, wheel caster and toe settings on vehicle performance. In some cases, tire temperatures may also suggest a need to modify these parameters or to replace or repair shocks, struts, control arms, tie rods, or other components of a vehicle or its handling or suspension systems. Moreover, tire pressure, which may be derived from tire temperatures, also has a significant impact on vehicle handling and performance, and hence is another metric closely monitored by pit crews.

In light of the foregoing, several tire temperature gauges and probes have been developed in the art, some of which are currently in use in performance motor sports applications. Unfortunately, many of the devices currently known to the art are not conducive to the demands of motor sports racing.

In particular, during a typical race, tire temperatures must be read quickly and accurately, without interfering with the many operations which must be performed on a vehicle within the very limited window of opportunity afforded by a pit stop. Ideally, these measurements should be taken at multiple points across the surface of each tire (and preferably at the inside edge, middle, and outside edge of the tire), since a tire may heat up unevenly during use, and since the tire temperatures prevailing at each of these points may provide useful diagnostic information about the performance of particular vehicle components. Unfortunately, many existing temperature gauges and probes require too much time for set-up or for taking temperature readings, or interfere with other operations which must be conducted during a pit stop. Moreover, the distance between the points on the surface of the tire at which temperatures are measured can vary from one set of measurements to the next due to variability in the placement of the temperature probe, thus increasing error in the resulting data.

There is thus a need in the art for devices and methodologies which overcome these shortcomings. In particular, there is a need in the art for devices and methodologies which allow for fast and accurate tire temperature readings at points of interest across the surface of a tire, and which do not interfere with other vehicle maintenance operations. These and other needs are met by the devices and methodologies disclosed herein and hereinafter described.

It has now been found that the aforementioned needs in the art may be met through the provision of a thermally insulated glove which is equipped with one or more temperature sensors. The temperature sensors are adapted to read the surface temperature of a tire in one or more locations (and possibly at multiple points in time) when the temperature sensors are activated and the glove is placed against the surface of the tire. The glove is preferably equipped with a data storage device for storing data generated by the temperature sensors, and is also preferably equipped with a toggling means for toggling between memory locations so that the temperature data recorded on a particular tire of a vehicle can be stored in a file or location associated with that tire. The temperature data is also preferably chronologically stamped so that multiple readings can be made (by the same or different temperature sensor) on a given tire during the course of a race, and can be differentiated and stored for later retrieval and manipulation.

FIGS. 1-4 illustrate a first particular, non-limiting embodiment of a temperature sensing glove in accordance with the teachings herein. The particular glove 101 shown therein has an aesthetic design which is based on the design disclosed in U.S. D515,782 (Mattesky), though it will be appreciated that various other designs may be employed in gloves made in accordance with the teachings herein.

Figure 2:
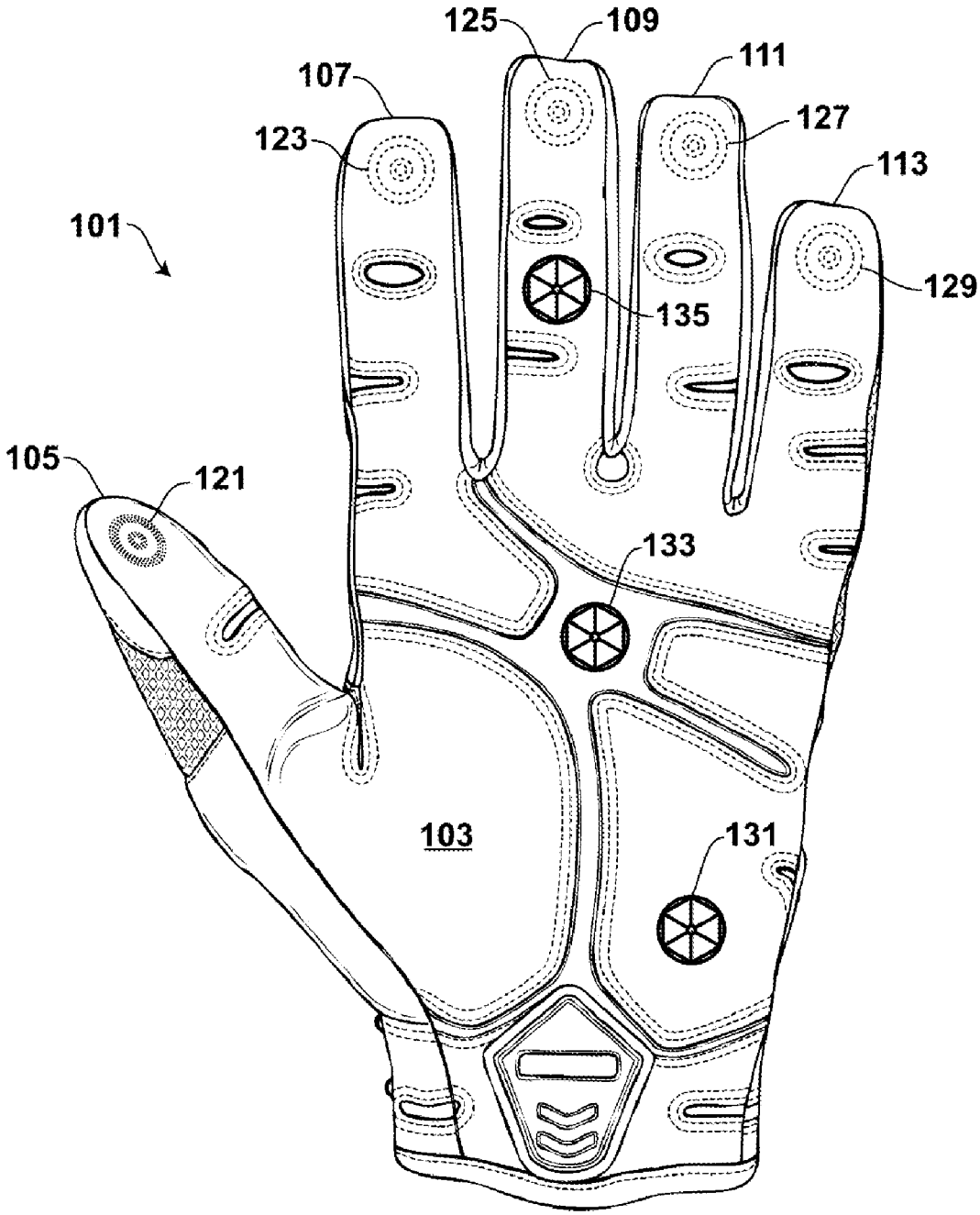
FIG. 2 is a perspective view of the temperature sensing glove of FIG. 1 showing the bottom side of the glove.

With reference to FIGS. 1-2, the glove 101 comprises a palm portion 103, a thumb portion 105, and finger portions 107, 109, 111 and 113. The palm portion 103 in this particular embodiment is equipped with first 131 and second 133 temperature sensors, with the first temperature sensor 131 being located near the heel of the palm portion 103 and the second temperature sensor 133 being located near the center of the palm portion 103. A third temperature sensor 135 is located approximately in the center of finger portion 109. This configuration of sensors is advantageous in that it allows the user to determine the temperature distribution across the face of the tire (and in particular, the temperature at each of the inside edge, middle, and outside edge of the tire) simply by placing the glove on the surface thereof. Moreover, since the distance between the temperature sensors is fixed, error arising from the relative placement of the sensors from one reading to the next is minimized.

Figure 3:
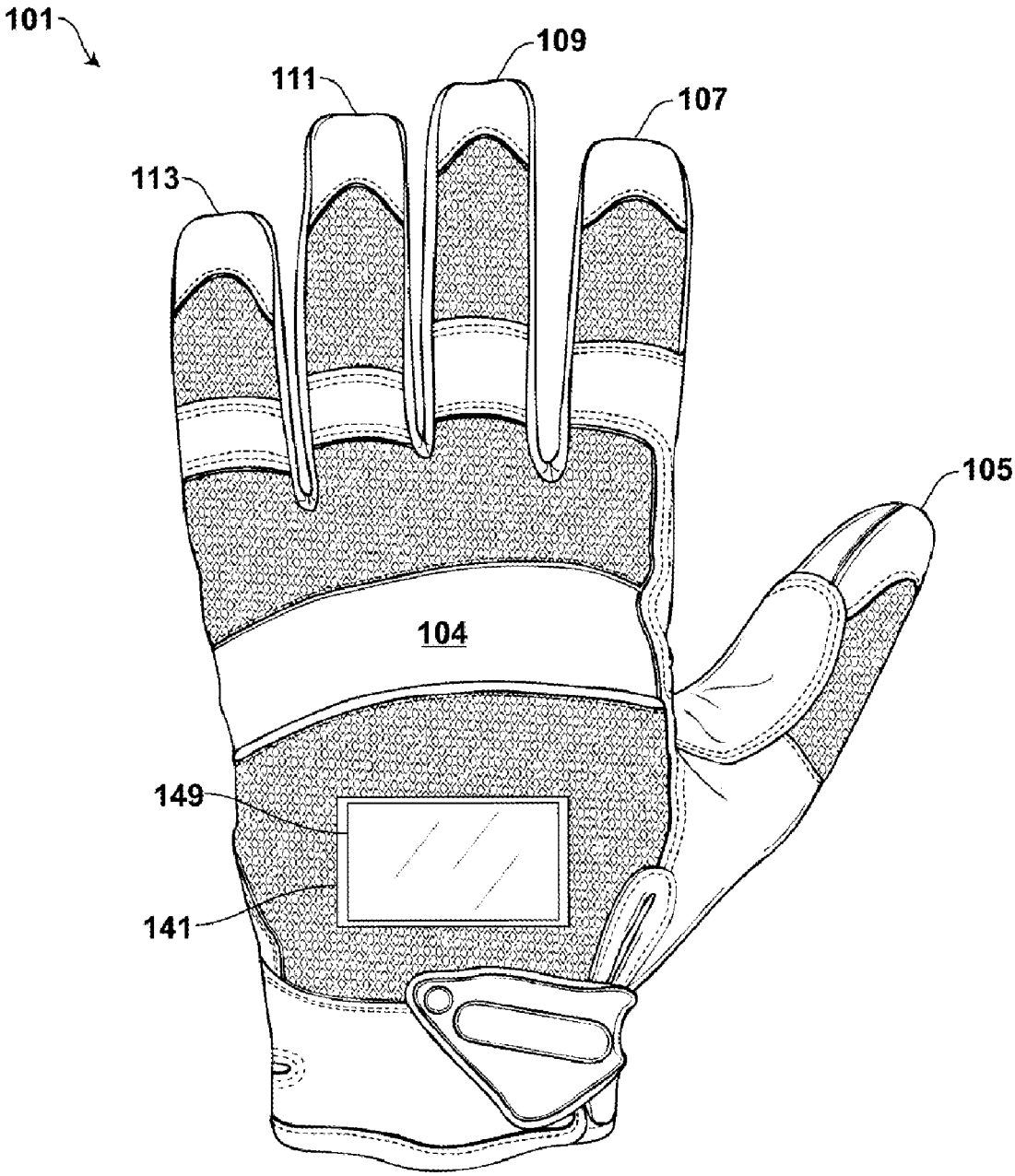
FIG. 3 is a perspective view of the temperature sensing glove of FIG. 1 showing the top side of the glove.

As seen in FIG. 3, the back hand portion 104 of the glove is equipped with a display module 141 containing a display window 149. The display window 149 preferably provides real time feedback of the temperatures being registered by temperature sensors 131, 133 and 135. The placement of the display window 149 on the back of the glove allows it to be easily read by the user during use, while minimizing incidental contact between the display module 141 and any objects the user handles.

The display window 149 allows the user to check whether the temperature sensors 131, 133 and 135 have been activated, and to verify which tire on a vehicle has been selected for a reading. The display window 149 may also provide real time feedback of the temperatures being registered at each of the temperature sensors 131, 133 and 135. This allows the user to determine when the sensor readings have stabilized, and to act on the resulting data, if necessary.

In some embodiments, the glove 101 may be equipped with a suitable speaker or indicator light so that an audible beep is emitted, or a visual indicator illuminates, when the readings at one or more of the temperature sensors 101, 103 and 105 have stabilized, or when sufficient data has been obtained to accurately determine the actual tire temperature at one or more of the temperature sensors 101, 103 and 105. In some embodiments, the nature of the audio or visual signal may take a first form when the glove is in a first state (e.g., while the temperature sensors have not yet stabilized, or while an accurate determination of temperature is not yet possible), and a second form when the glove is in a second state (e.g., after the temperature sensors have stabilized, or when an accurate determination of temperature becomes possible). For example, the frequency of the audio signal may change when the glove transitions from the first to the second state, or the indicator light may blink in the first state and remain steady in the second state, or may change colors or indicia in transitioning from the first state to the second state.

In some embodiments, the glove may be equipped with a suitable processor that determines temperatures based on the initial temperature response of the temperature sensors 101, 103 and 105, rather than through direct measurement of the temperature. In some embodiments, the glove 101 may also be equipped with a suitable processor which generates instructional messages based on the temperature readings, such as, for example, "Maximum Recommended Tire Temperature Exceeded", or "Excessive Temperature Variation Detected".

Figure 4:
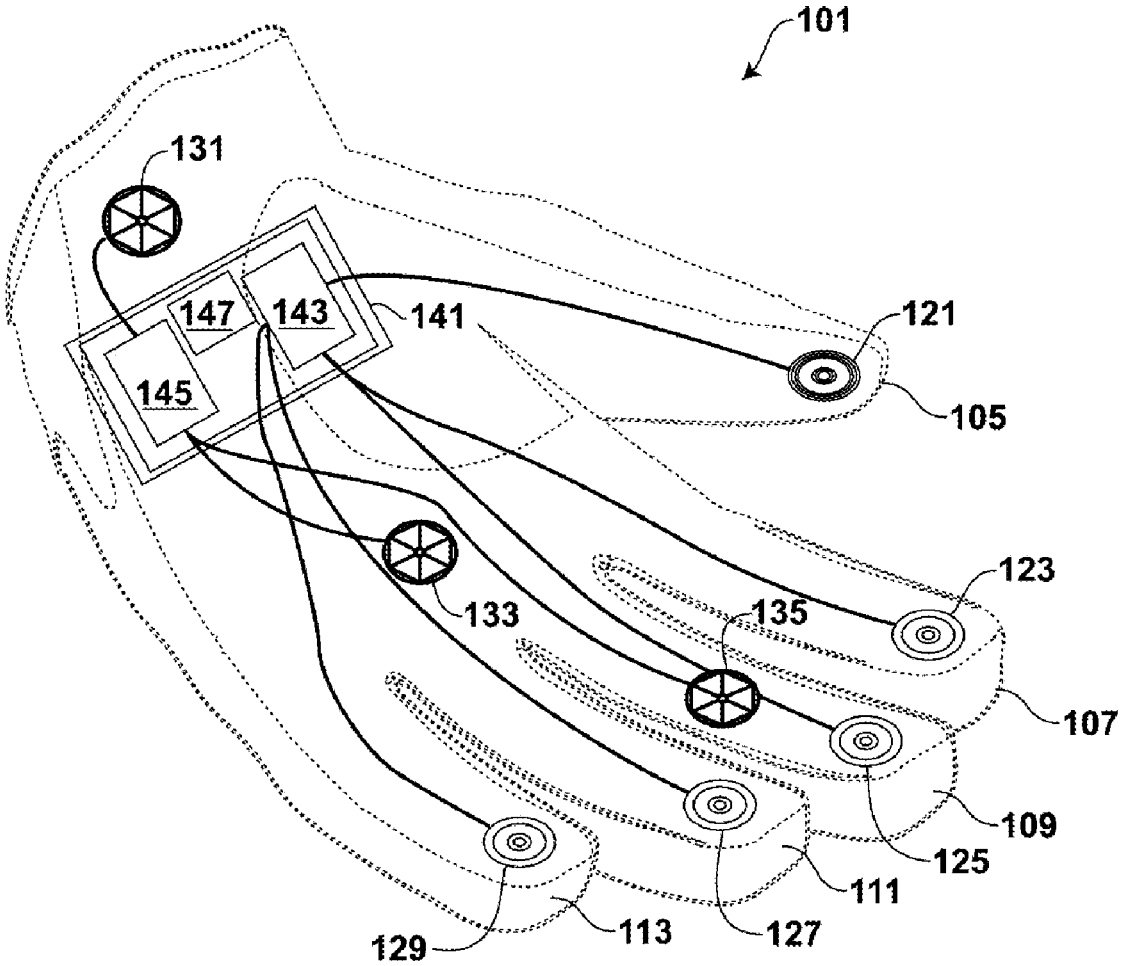
FIG. 4 is an illustration of the electronic circuitry of the temperature sensing glove of FIG. 1.

FIG. 4 depicts one particular, non-limiting embodiment of the electronic circuitry of the glove of FIGS. 1-3. As seen therein, the thumb portion 105 of the glove 101 is equipped with a switch receptor 121, and finger portions 107, 109, 111 and 113 are equipped with switch activators 123, 125, 127 and 129, respectively. Together, the switch activators 123, 125, 127 and 129 and the switch receptor 121, which are in electronic communication with display module 141 and the control circuitry 143 thereof, form a complete switch. Similarly, temperature sensors 131, 133 and 135 (note that temperature sensor 131 in FIG. 4 has been moved from its normal position for ease of illustration) are in electronic communication with display module 141 and the control circuitry 145 thereof, the latter of which is in communication with memory module 147.

In some embodiments, the memory module 147 may be removable from the glove. Thus, for example, the memory module may be a flash memory device of the type commonly used in digital cameras. This permits the glove to be used with multiple vehicles over the same time period, and also provides a convenient means of data transfer and storage.

During use of the glove 101, the user activates the temperature sensors 131, 133 and 135 by bringing one of the fingers 107, 109, 111 and 113 into contact with thumb portion 105 so that one of the switch activators 123, 125, 127 and 129 is brought into close proximity with the switch receptor 121. The particular finger used for activation in this embodiment associates the subsequent readings with a particular tire on the vehicle. Thus, for example, in one possible embodiment, the finger portion 107 (corresponding to the index finger) may be associated with the left rear tire, the finger portion 109 (corresponding to the middle finger) may be associated with the right rear tire, finger portion 111 (corresponding to the ring finger) may be associated with the front right tire, and finger portion 113 (corresponding to the pinky finger) may be associated with the front left tire. Preferably, the association between finger portions and tires follows a sequential progression in either a clockwise or counterclockwise progression around the vehicle. Suitable indicia reflecting these associations may be placed on appropriate surfaces or fingers of the glove, or may be displayed in display window 149. Of course, it will be appreciated that the glove may be suitably adapted to account for the possibility that only a subset of the tires on the vehicle may be probed at any one time (for example, it may be desirable to check the front tires more frequently than the rear tires, given the greater impact of the front tires on vehicle handling and performance).

The memory module 147 in the display assembly 141 places the temperature data from the reading in a data file associated with the respective tire. In some embodiments, the glove 101 may be equipped with a suitable transmitter so that data registered or recorded by the device may be transmitted wirelessly to a computer, network or other such device or system. This may occur simultaneously with the reading, or may occur at a time subsequent to the reading.

Preferably, a unique chronological stamp (which may include time and/or date identifiers, or the amount of time elapsed from some reference point) is associated with each data set, and the temperature data within each set is associated with the temperature sensor which generated the data. Each data set is also preferably associated with a particular tire on the vehicle. The data may then be retrieved for suitable analysis or manipulation, either during or after a race, so that, for example, the response of a particular tire to race conditions can be analyzed.

Various modifications are possible to the foregoing embodiment. For example, in some embodiments, switch receptor 121 and switch activators 123, 125, 127 and 129 may be eliminated. In such embodiments, the correspondence between a temperature data set (and the tire the readings correspond to) may be established through a suitable selection made on the display module 149, which is preferably touch sensitive. In some such embodiments, a stylus or one or more keys may be provided adjacent to the display as data entry devices, or to permit the user to make a menu selection. In other possible embodiments, an opposing glove may be provided which has a stylus or other such device built into one of the fingers thereof to facilitate the selection process.

Moreover, it is to be understood that the glove may be used (or may be adapted) to make more than one set of readings on a given tire. This may be the case, for example, if the tire is too wide to permit the glove to extend across its width, in which case temperature readings across the complete width of the tire may be made by positioning the glove multiple times on the surface of the tire as needed to make the desired readings. One or more additional switches, sensors, algorithms or commands may be provided in, or implemented by, the glove to facilitate such subsequent readings. Thus, for example, in some embodiments, the user may make a data input selection (as, for example, through a given sequence of finger clicks) which activates the glove for additional readings on the same tire.

Figure 5:
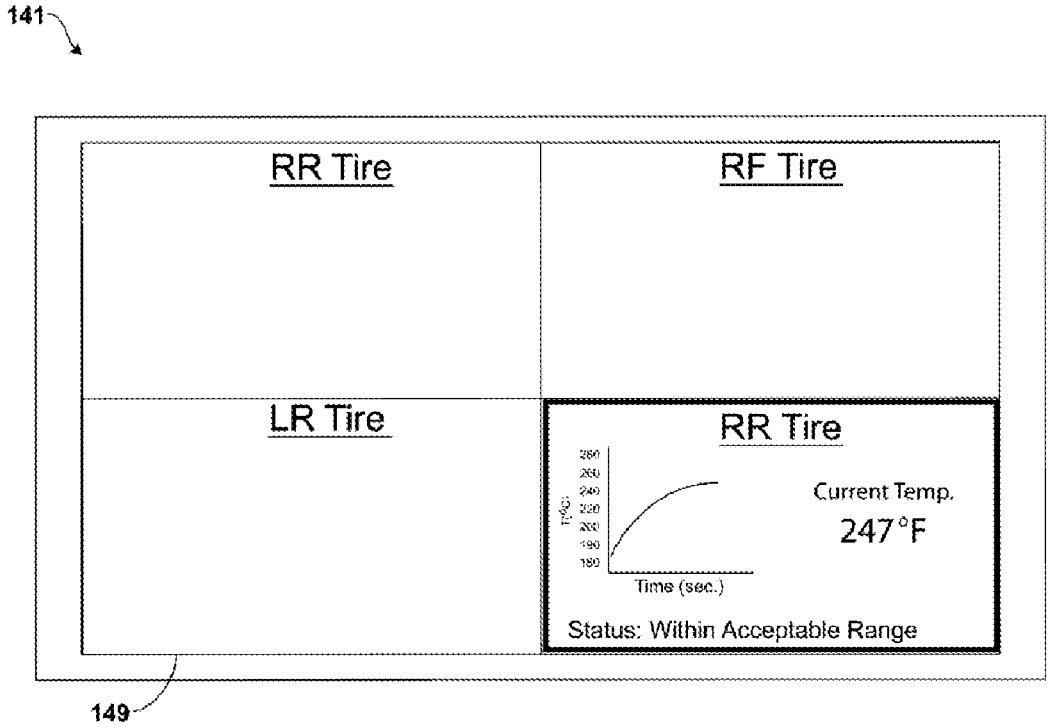
FIG. 5 is an illustration of an Display module useful in some embodiments of a temperature sensing glove made in accordance with the teachings herein.

One suitable display module 141 for this type of embodiment is depicted in FIG. 5. The Display module 141 in this embodiment contains a display window 149 which is touch-sensitive and which is divided into four quadrants, each corresponding to one of the tires on a vehicle. The denotations LF, RF, LR and RR stand for "Left Front", "Right Front", "Left Rear" and "Right Rear", respectively. By repetitively touching one of the quadrants, the user can toggle the glove among an inactive state and an active state. When the glove is in an active state, it is set to record temperatures at one or more temperature sensors disposed in the glove, and to associate those readings with the tire associated with the quadrant selected. The display module 141 may be configured, either additionally or in the alternative, to permit a quadrant to be activated or deactivated through the use of switch receptor 121 and switch activators 123, 125, 127 and 129 as described above.

In the particular embodiment depicted, the selected quadrant is highlighted by a border, and the remaining quadrants are rendered blank. The current temperature registered by the glove is displayed, and a graph of the temperature reading as a function of time is displayed so that the user can determine if the temperature has stabilized. In embodiments having more than one sensor, the temperature displayed and graphed (if these functions are implemented) may be an average of the temperatures registered at each of the temperature sensors. Alternatively, once a particular tire is selected for a reading, the temperature data for each sensor may be separately displayed in one of the quadrants. It will be appreciated, of course, that various other types of data may be registered on the display window 149, and that the display module 141 may be adapted to allow the user to customize the type and format of data to be displayed.

In some variations of this embodiment, touching a quadrant a first time activates the glove for reading to the files associated with the tire corresponding to that quadrant, touching the quadrant a second time in succession enlarges the displayed data to full screen mode so it is easier to read (that is, the selected quadrant is displayed over the entire area of display window 149), and touching the quadrant a third time in succession deactivates the glove. A number of variations are possible to this approach, with each successive touch toggling to a different state of the display window 149 or glove 101. It will be appreciated, of course, that the foregoing methodologies may be applied to create embodiments in which the display module 149 is divided into more than, or less than, four parts.

Figure 6:
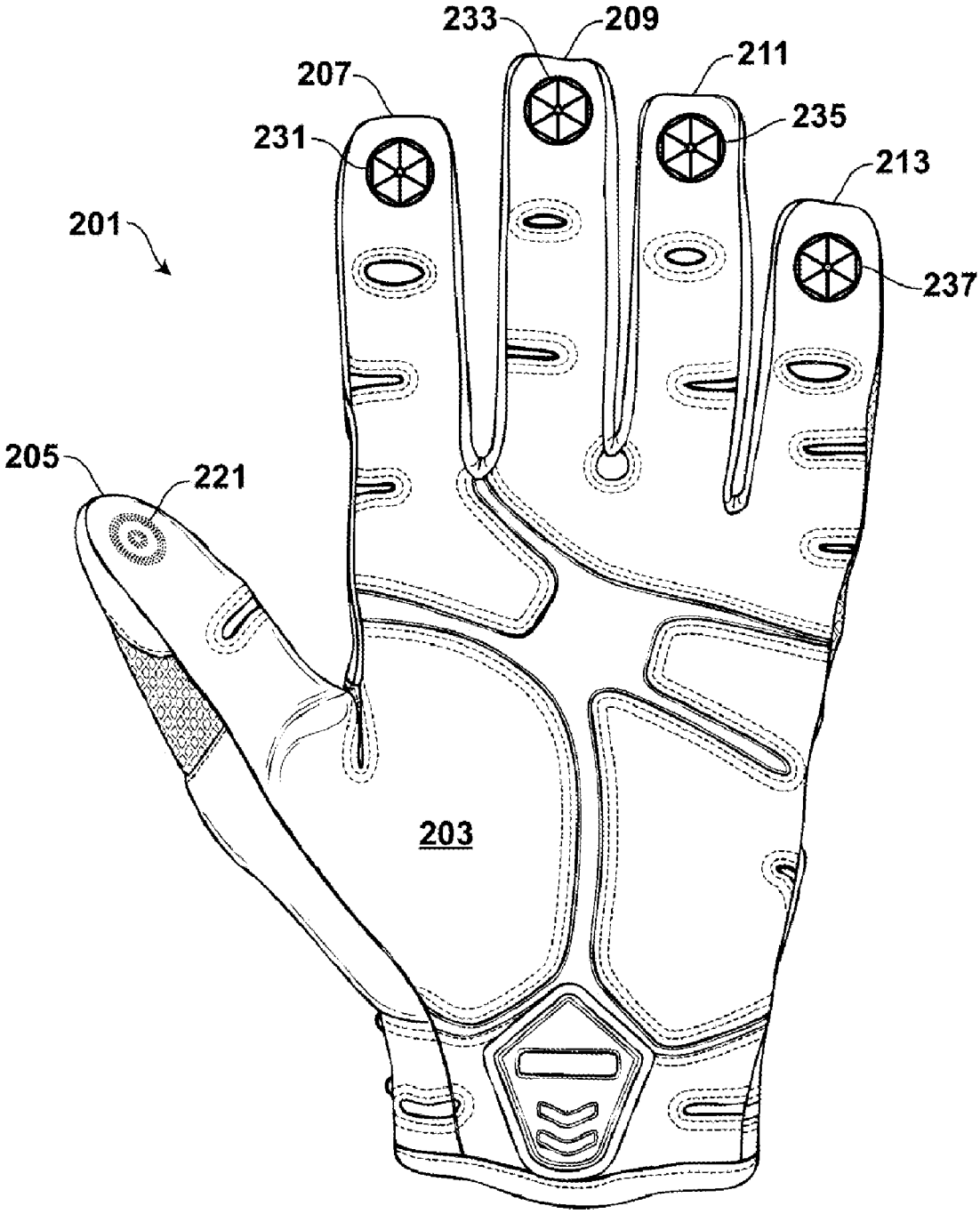
FIG. 6 is a perspective view of a second particular, non-limiting embodiment of a temperature sensing glove made in accordance with the teachings herein.

FIG. 6 depicts a second particular, non-limiting embodiment of a temperature sensing glove 201 in accordance with the teachings herein. The back hand side of the glove 201 of this embodiment is identical to FIG. 3. In this embodiment, temperature sensors 231, 233, 235 and 237 are disposed near the tips of finger portions 207, 209, 211 and 213, respectively. A temperature sensor activator 221 is disposed on the thumb portion 205 of the glove 201. In use, any of the temperature sensors may be activated and deactivated by successively touching the temperature sensor activator 221 to one of temperature sensors 231, 233, 235 and 237. In some embodiments, more than one of the temperature sensors may be activated at a time, while in other embodiments, activating one of the temperature sensors 231, 233, 235 and 237 will automatically deactivate any other activated temperature sensor.

In some possible variations of the embodiment of FIG. 6, all of the temperature sensors 231, 233, 235 and 237 will read to a file which may be associated with a particular tire on a vehicle, thereby allowing temperatures to be read at multiple locations on a tire. The pit crew or tire manufacturer may mark the areas in which temperature readings are to be made for consistency in the readings as, for example, by placing a small circle in each of the desired areas (it being understood that superficial markings made on the surfaces of the tire which contact the track may be burned off). In other variations of the embodiment of FIG. 6, each of the temperature sensors 231, 233, 235 and 237 may be associated with a particular tire, and any readings made at that sensor may be automatically associated with that particular tire. As with the previous embodiment, the readings are preferably chronologically stamped.

Figure 7:
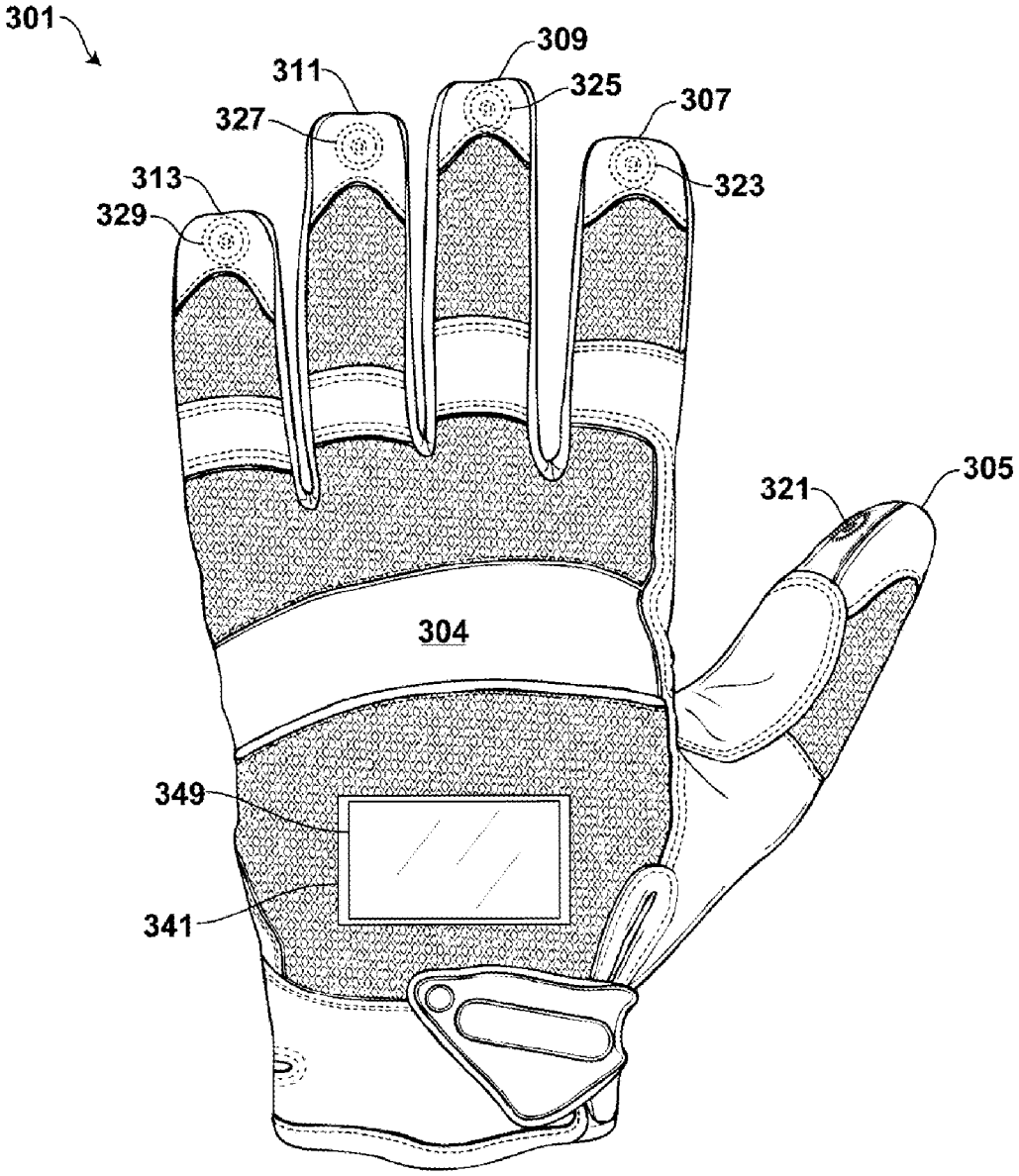
FIG. 7 is a perspective view of a third particular, non-limiting embodiment of a temperature sensing glove made in accordance with the teachings herein.

FIG. 7 illustrates the back hand portion of a third particular, non-limiting embodiment of a temperature sensing glove 301 in accordance with the teachings herein. The front hand portion is similar to the front hand portion of FIG. 6, except that the temperature sensor activator 221 of FIG. 6 is replaced by a switch activator 321 which acts in a manner similar to switch activator 121 of FIG. 2.

In the glove 301 depicted therein, the fingernail portions of each of finger portions 307, 309, 311 and 313 are equipped with switch activators 223, 225, 227 and 229, respectively.

The operation of this embodiment is similar to the operation of the embodiment depicted in FIGS. 1-3. In particular, switch receptor 321 is touched to one of switch activators 323, 325, 327 and 329 to activate one or more temperature sensors and/or to assign readings made at those temperature sensors to a particular tire on a vehicle.

Various materials may be used in the construction of the gloves described herein. Preferably, the outer surface of the glove will comprise materials with adequate heat resistance for handling hot tires, while also providing suitable grip characteristics. The glove will preferably also comprise one or more materials which thermally insulate the interior of the glove from the outer surface of the glove. Such materials may provide thermal insulation by, for example, reducing conductive heat transfer or retarding the movement of hot air through the glove, or by reducing radiative heat transfer to the interior of the glove.

Some specific, non-limiting examples of materials which may be used in the construction of gloves made in accordance with the teachings herein include acrylonitrile-butadiene-styrene (ABS) polymers, polyacetates, polyacrylics, acetal resins, epoxies, fiberglass, glass fibers, polyimides, polycarbonates, neoprene rubbers, polyamides, nylon, polyesters, cotton, polystyrene (including expanded polystyrene), polyolefins, polyurethanes, polyisocyanurates, cellulose, mineral wool, rock wool, polyvinylchlorides (PVCs), silicone/fiberglass composites, epoxy/fiberglass composites, silicone rubbers, polytertrafluoroethylene (PTFE), polysulfones, polyetherimides, polyamide-inides, polyphenylenes, and asbestos. Foams based on neoprene, polystyrene, polyurethane, and silicone rubbers may be especially useful for portions of the glove.

It will be appreciated that, while the use of display modules and windows are preferred in the gloves described herein, various other displays may be utilized, including, for example, heads up displays. Thus, for example, in some embodiments, the glove may be in communication with a set of glasses or goggles worn by the user which displays data from the glove in the user's field of vision. In such embodiments, the glove may be equipped with a mouse or its equivalent which allows the user to browse through various files, menus or screens and to make selections or entries in the same.

Various modifications and substitutions may be made to the foregoing embodiments, as will be apparent to one skilled in the art. For example, while the temperature sensing gloves described herein have been frequently referred to or described as having a unitary construction, in some embodiments, these gloves may have a multi-component structure. For example, in one such embodiment, the glove may have a core and shell construction in which the core is a normal working glove of a type suitable for use by a member of a pit crew, and in which the shell fits over the core and contains the temperature sensing devices and associated electronics as described herein. In such embodiments, the shell may be constructed so that it can be quickly and easily placed over, or removed from, the core. Consequently, the shell may be readily removed from the glove when it is not needed for temperature sensing purposes, thus preventing it from hindering the user in carrying out other tasks or from being damaged in the performance of those tasks.

In a related embodiment, the temperature sensing elements, display and/or memory devices may be constructed so that they are readily removable from the glove when their use is not required. For example, these components may be releasably attachable to the glove (as, for example, through the use of repositional fasteners, snaps, or other releasably attaching means as are known to the art), and may be equipped with elements that releasably connect to circuitry embedded within the glove.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. A temperature sensing glove, comprising:

at least one temperature sensor;

a plurality of memory locations;

a plurality of finger portions;

at least one touch-sensitive pad which is associated with one of said plurality of memory locations;

a thumb portion; and at least one activating element which, upon contacting one of the at least one touch-sensitive pads, assigns subsequent readings of the at least one temperature sensor to the memory location associated with that finger portion.

2. The temperature sensing glove of claim 1, wherein at least one activating element is disposed in the thumb portion.

3. The temperature sensing glove of claim 1, wherein at least one activating element is disposed in each of said plurality of finger portions.

4. The temperature sensing glove of claim 1, wherein the glove comprises a palm portion, and wherein the at least one temperature sensor is built into the palm portion of the glove.

5. The temperature sensing glove of claim 1, wherein the at least one temperature sensor is built into the thumb portion of the glove.

6. The temperature sensing glove of claim 1, wherein the glove comprises a thumb portion, and wherein at least one touch-sensitive pad is built into the thumb portion of the glove.

7. The temperature sensing glove of claim 4, wherein at least one activating element is disposed in each of said plurality of finger portions, and wherein each activating element disposed in a finger portion assigns, upon contacting one of said at least one touch-sensitive pads, subsequent readings of the at least one temperature sensor to the memory location associated with that finger portion.

8. The temperature sensing glove of claim 1, wherein each of the plurality of finger portions is equipped with an indicia associating that finger portion with the location of a tire on a vehicle.

9. The temperature sensing glove of claim 1, wherein the at least one temperature sensor comprises a plurality of temperature sensors, and wherein each of said plurality of temperature sensors is disposed in one of said plurality of finger portions.

10. The temperature sensing glove of claim 7, wherein the activating element activates one of the plurality of temperature sensors such that the next temperature reading made by that temperature sensor is assigned to a memory location associated with the finger portion the temperature sensor is disposed in.

11. The temperature sensing glove of claim 7, further comprising a display adapted to display temperature data registered by at least one of the plurality of temperature sensors.

12. The temperature sensing glove of claim 9, wherein the glove further comprises a back hand portion, and wherein the display is disposed on said back hand portion.

13. The temperature sensing glove of claim 1, wherein said glove comprises first, second and third temperature sensors.

14. The temperature sensing glove of claim 11, wherein the glove comprises a heel portion having said first temperature sensor disposed thereon, a palm portion having said second temperature sensor disposed thereon, and a middle finger portion having said third temperature sensor disposed thereon.

15. The temperature sensing glove of claim 12, wherein said second temperature sensor is disposed in the center of said palm portion.

16. The temperature sensing glove of claim 11 in combination with a tire, wherein said glove is adapted to position said first, second and third sensors respectively at the outer edge, center, and inner edge of the tire when the glove is placed thereon.

17. A temperature sensing glove, comprising:

a temperature sensor disposed in a first finger of the glove;

a temperature sensor activator disposed in a second finger of the glove, and being adapted to activate said temperature sensor when it is brought into proximal contact therewith;

a plurality of memory locations;

at least one touch-sensitive pad which is associated with one of said plurality of memory locations; and at least one activating element disposed in each of said first and second fingers of the glove which, upon contacting one of the at least one touch-sensitive pads, assigns subsequent readings of the at least one temperature sensor to the memory location associated with that finger portion.

18. A method for monitoring tire temperatures, comprising:

providing a temperature sensing glove having (a) at least one temperature sensor, (b) a plurality of memory locations, (c) for each of said at least one temperature sensors, an activator which assigns a temperature reading made by the at least one temperature sensor to one of the plurality of memory locations, and (d) a display adapted to display temperature readings;

contacting a tire with the glove such that the at least one temperature sensor is in thermal contact with the tire; and reading a temperature reading from the display.

19. The method of claim 18, wherein the glove comprises first, second and third temperature sensors.

20. The method of claim 19, wherein the glove comprises a heel portion having said first temperature sensor disposed thereon, a palm portion having said second temperature sensor disposed thereon, and a middle finger portion having said third temperature sensor disposed thereon.

21. The method of claim 20, wherein said second temperature sensor is disposed in the center of said palm portion.

22. The method of claim 18, wherein using the glove to make a temperature reading on a tire comprises positioning the first, second and third sensors respectively at the outer edge, center, and inner edge of the tire.

* * * * *